United States Patent [19]

Holloman

[11] Patent Number: 4,682,162

[45] Date of Patent: Jul. 21, 1987

[54] ELECTRONIC DISPLAY UNIT

[75] Inventor: Charles J. Holloman, Norwalk, Conn.

[73] Assignee: Trans-Lux Corporation, Norwalk, Conn.

[21] Appl. No.: 650,781

[22] Filed: Sep. 14, 1984

[51] Int. Cl.[4] ..... G09G 3/22

[52] U.S. Cl. ..... 340/799; 340/718; 340/719

[58] Field of Search ..... 340/718, 719, 771, 778, 340/803, 792, 799; 357/10, 19, 23, 34, 44, 45, 73

[56] References Cited

U.S. PATENT DOCUMENTS

| | | | |
|---|---|---|---|
| 3,728,714 | 4/1973 | Kolesor et al. | 340/792 X |
| 3,787,833 | 1/1974 | Rogers | 340/792 X |
| 3,999,179 | 12/1976 | Prame | 340/800 X |
| 4,051,389 | 9/1977 | Kaneko et al. | 357/44 X |
| 4,193,126 | 3/1980 | Smith | 357/45 X |
| 4,236,154 | 11/1980 | Lee | 340/792 X |
| 4,368,467 | 1/1983 | Unotoro et al. | 340/799 |
| 4,386,351 | 5/1983 | Lowdenslager | 340/792 X |
| 4,406,997 | 9/1983 | Depp et al. | 340/718 |
| 4,430,648 | 2/1984 | Togashi et al. | 340/799 X |

*Primary Examiner*—Gerald L. Brigance
*Assistant Examiner*—Jeffery A. Brier
*Attorney, Agent, or Firm*—Kane, Dalsimer, Sullivan, Kurucz, et al.

[57] ABSTRACT

An electronic display unit according to this invention is formed of a plurality of display elements arranged in a two dimensional array. The display elements are selectively activated to generate a message. All the preselected display elements are activated and deactivated simultaneously. The message may be moved vertically or laterally across the array. A memory element is provided for activating each display element. Preferably the information from each memory element is simultaneously shifted laterally to an adjacent memory element while the display elements are disabled.

A buffer is provided as an interface between each display element and the corresponding memory element. The intensity of each display element may be controlled by varying the power supply level to the buffer.

12 Claims, 13 Drawing Figures

SERIAL OUT
ENABLE
LOGIC GATE 24
TO DISPLAY ELEMETS 14
CLOCK
SERIAL IN
CLEAR
VCC
VSS
VSS'
LOGIC BUS
D-LATCH
D Q CLR

ELECTRONIC DISPLAY UNIT

BACKGROUND OF THE INVENTION a. Field of Invention

This invention pertains to a device and method for displaying various messages on an electronic display unit comprising a plurality of elements arranged in a two dimensional array.

b. Description of the Prior Art

Display devices having a two dimensional array of display elements are frequently used for displaying various types of information. Typically such display units are relatively large so that they are visible from various distances, and the messages are displayed by selectively activating and deactivating the display elements to generate various alphanumeric or other types of characters. Furthermore it was found advantageous to move messages vertically or horizontally across the display unit by activating preselected display units in a preselected sequence. Normally the display elements are activated by the so-called scanning array technique in which the display elements are activated sequentially. However it was found that due to the time lag between the activation of first and last display elements of a particular character, the message often appears to the viewer to tilt in the direction of movement of the message. Furthermore, because the display elements are activated sequentially, the whole message appears to waver.

Some of the display elements comprise means of emitting light such as light emitting diodes. The intensity of these type of elements is typically varied by turning them on and off periodically and changing their duty cycle. However it was found that due to slight manufacturing differences there is a difference in intensity between the elements so that the overall message is not uniform. Furthermore it was found that turning these elements on and off causes the message to flicker.

In general it was found that a message displayed by the scanning array technique is difficult to see while a person is moving.

OBJECTIVES AND SUMMARY OF THE INVENTION

A principal objective of this invention is to provide a display unit which can display moving messages without tilt or other distortions.

Another objective is to provide a display unit having LED's in which the intensity LED may be uniformly controlled.

A further objective is to provide a unit which may be adapted to move messages either horizontally or vertically.

Other objectives and advantages of the invention shall become apparent from the following description of the invention. According to this invention a display unit comprises a plurality of display elements arranged in a two-dimensional array and control means for selectively activating the display elements to generate a preselected message, each element used to generate said message being activated simultaneously. The control means comprises a plurality of memory means corresponding to said display elements for storing information indicative of the status of the respective display element. The memory means are constructed and arranged to pass said information in a preselected direction. The control means also comprises means for activating said display elements in accordance with said information. The intensity of said display elements is changed by varying the power supply of said activating means.

DETAILED DESCRIPTION OF THE INVENTION

Figures 1A, 1B, 3:
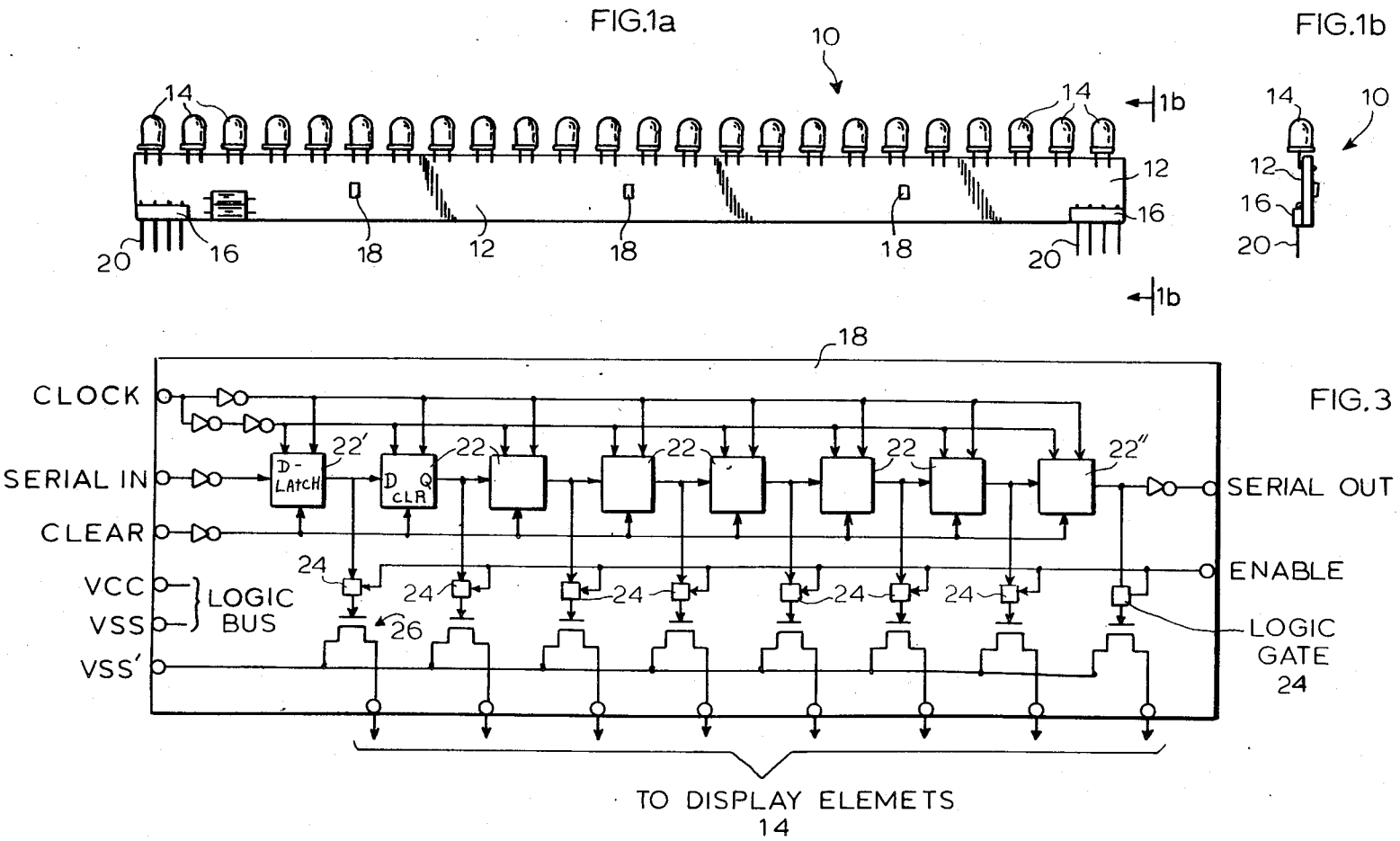
FIG. 1*a* and 1*b* show a side and an end view respectively of a board having a plurality of display elements in accordance with the present invention.
FIG. 3 shows a schematic diagram for the control circuit mounted on the board of FIGS. 1*a*, 1*b* and 2.

A display unit, in accordance with this invention, comprises a plurality of boards arranged in rectangular array as required, each board including a preselected number of display elements and are one or more logic circuits for selectively activating said element. One such board 10 is shown in FIGS. 1*a* and 1*b*. It comprises a base 12, display elements 14, connectors 16 and logic circuits 18. The base is a typical non-conducting material used for printed circuit boards on which a plurality of connecting strips (not shown) have been etched or otherwise deposited as required to interconnect the other elements of the board in accordance with the schematic diagram of FIG. 2.

Each of the connectors 16 comprise four or more pins 20 extending away from the base 12 so that the board may be plugged into a motherboard (not shown) edgewise. Display elements 14 extend away from the base on the side and in a direction opposite pins 20 so that a plurality of boards could be mounted side by side vertically in a single mother board with the display elements of the different boards being disposed adjacent to each other in a single plane. Display elements 14 preferably comprise a light emitting diode (LED) of a preselected color such as red, yellow or green. With slight modification, the display elements could also comprise incandescent bulbs, gas discharge, or other similar light emitting or controlled contrast devices suitable for displaying messages.

Typically board 10 is provided with 24 display elements. Of course the number of display elements may be increased or decreased as desired.

Figure 2:
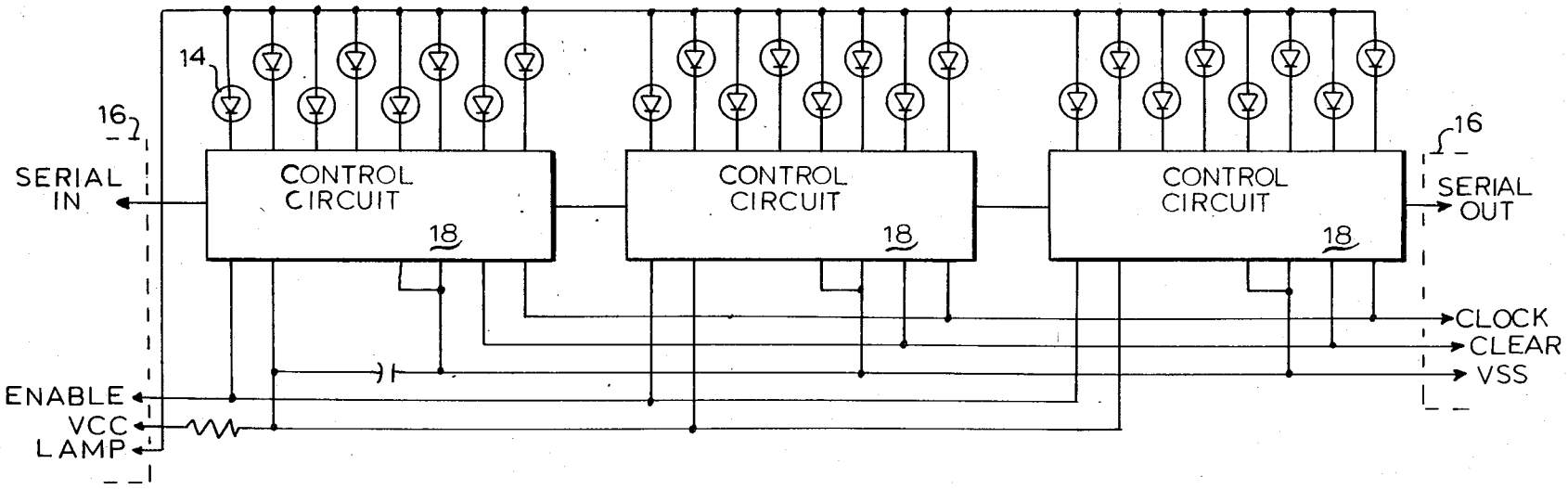
FIG. 2 shows a wiring diagram for the board of FIGS. 1*a*, 1*b* and 2.

The wiring diagram for board 10 is shown on FIG. 2. All the display elements 14 have one terminal connected to a common LAMP bus. The other terminal of each element 14 is connected to a control circuit 18 adapted to selectively activate elements 14 as shall be described more fully below. Connectors 16 also provide connections to lines for the CLOCK, CLEAR ENABLE, SERIAL IN and SERIAL OUT signals. Furthermore a Vcc and Vss bus is provided as power supply means for the control circuits 18.

The schematic diagram for each control circuit 18 is shown in FIG. 3. It can be seen from this Figure that each control circuit comprises eight D-type latches or flip-flops 22 connected in series, with the first latch 22' getting the SERIAL IN line as an input and the last latch 22" generating the SERIAL OUT signal.

The eight latches 22 are arranged and connected to form a serial-in/serial-out shift register with the bits being shifted from left to right through each latch sequentially with positive transition of the CLOCK signal. In addition the output of each latch is fed to a logic gate 24. A second input of each gate 24 is connected to the ENABLE line as shown. The output of logic gate is connected to the gate of an FET switch 26. Each gate 24 and FET switch 26 is arranged so that the FET switch is activated when the output of the gate 24 is high. The drain of each FET switch is connected to a common return bus Vss'. The source of each FET switch is used to drive a corresponding display element 14 as shown.

Thus data presented at the SERIAL IN input to the control circuit is shifted through each latch 22 by pulses on the CLOCK line, and is transmitted to the SERIAL OUT line by the last latch 22. Whenever an ENABLE signal is received on the ENABLE bus the display elements controlled by circuit 18 are selectively activated, the state of each element 14 being determined by the state of the corresponding latch 22. For example if the output of a particular latch 22 is high the corresponding display element 14 is ON, and vice versa.

Board 10 is shown in FIGS. 1 and 2 as having three control circuits 18, one for each set of eight display elements 14. Obviously, a single control circuit 18 could also be provided having 24 latches. Control circuits 18 is preferably provided as a CMOS integrated chip.

Figure 4:
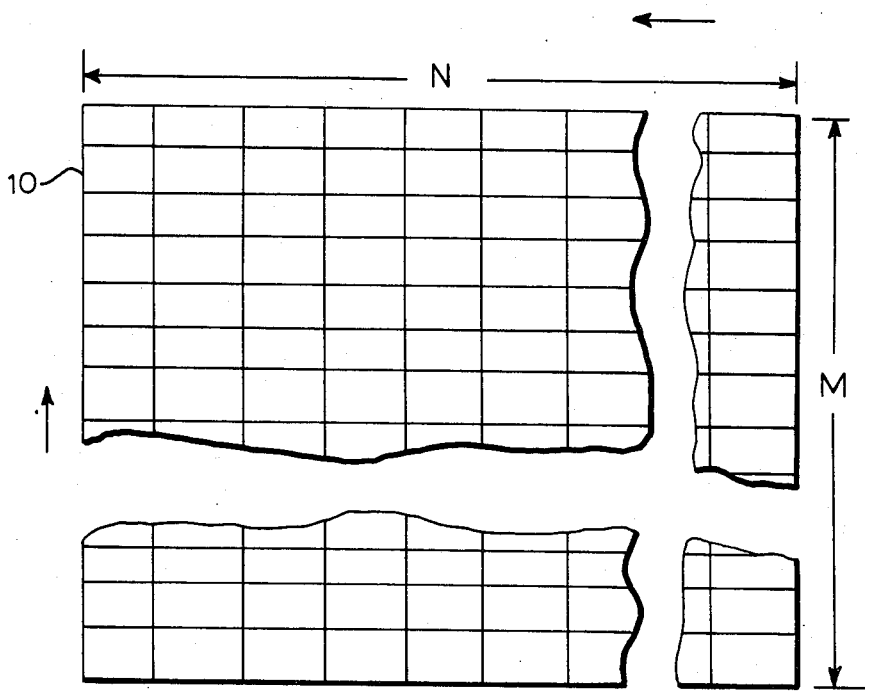
FIG. 4 shows a display unit having a plurality of boards in accordance with the present invention.

A typical display unit is then formed by mounting a plurality of boards in a matrix of N columns by M rows as shown in FIG. 4. Each row comprises N boards connected end to end so that the SERIAL OUT line of one board feeds the SERIAL IN line of the next board. Furthermore the boards are connected so that the data is shifted from right to left as the display unit is viewed from the front, across each row. Thus if a board has A display elements the total number of display elements D per display unit is given by $$D=AMN.$$

Figure 5A:
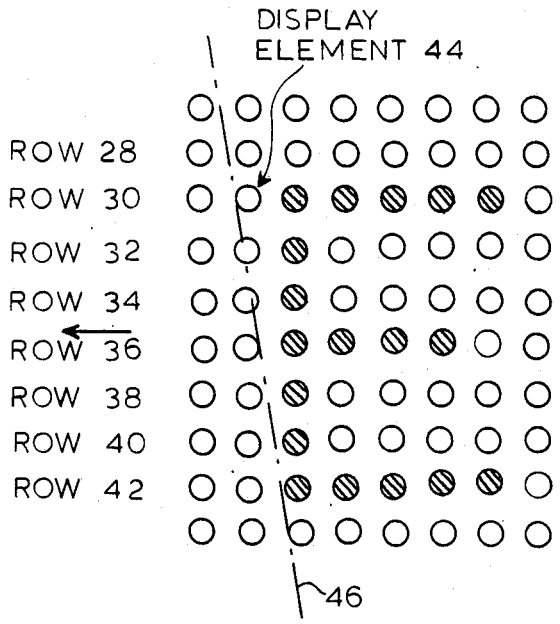
FIG. 5*a* shows a plurality of display elements used to generate an alphanumeric character.
Figure 5B:
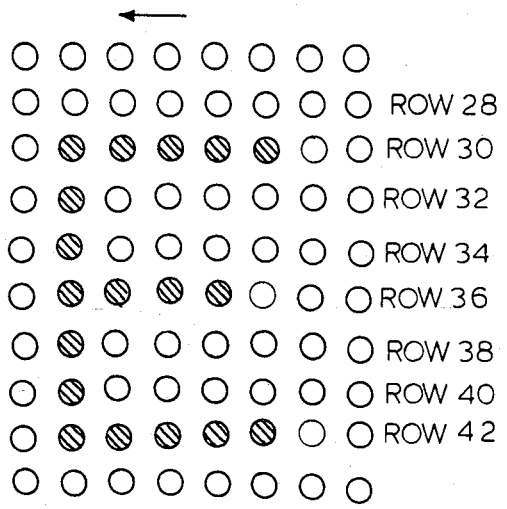
FIG. 5*b* shows the alphanumeric character of FIG. 5*b* shifted to the left.
Figure 5C:
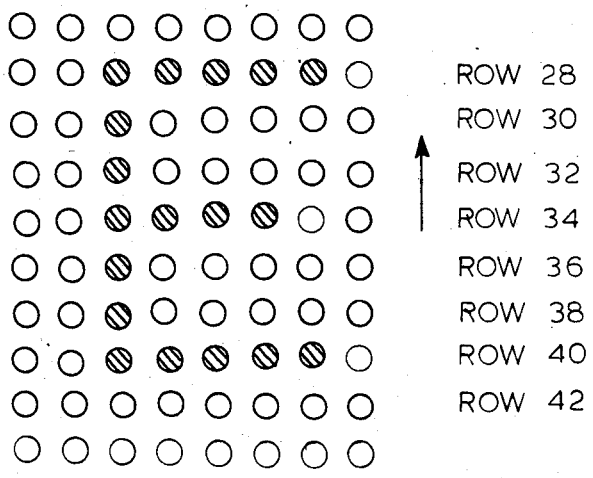
FIG. 5*c* shows the alphanumeric character of FIG. 5*a* shifted upwards.

The display unit of FIG. 4 can be operated in a number of different modes. These modes are illustrated in FIGS. 5*a*, 5*b* and 5*c*. In FIG. 5*a* a subset of $8\times10=80$ display elements are shown. In order to display a letter "E" row 28 is left off, five display elements of row 30 are activated one element in row 32 is activated, and so on all the way to row 42. It is understood that this letter is part of a message being displayed by the display unit. It is frequently desirable to move the message laterally across the display unit, for example from right to left. As previously mentioned, in the prior art, this has been accomplished by activating the display elements sequentially. For example in order to move the letter "E" of FIG. 5*a* by one column to the left by the scanning array technique the elements of top row 30 are sequentially shifted to the left followed sequentially by the elements of each of the rows 32–42. Thus element 44 of row 30 is activated before the elements of rows 32–42 are shifted. Although the shifting is done fairly rapidly, the eye of an observer, which is very sensitive to changes in a particular light configuration, see the letter "E" as being tilted along line 46.

Figure 6A:
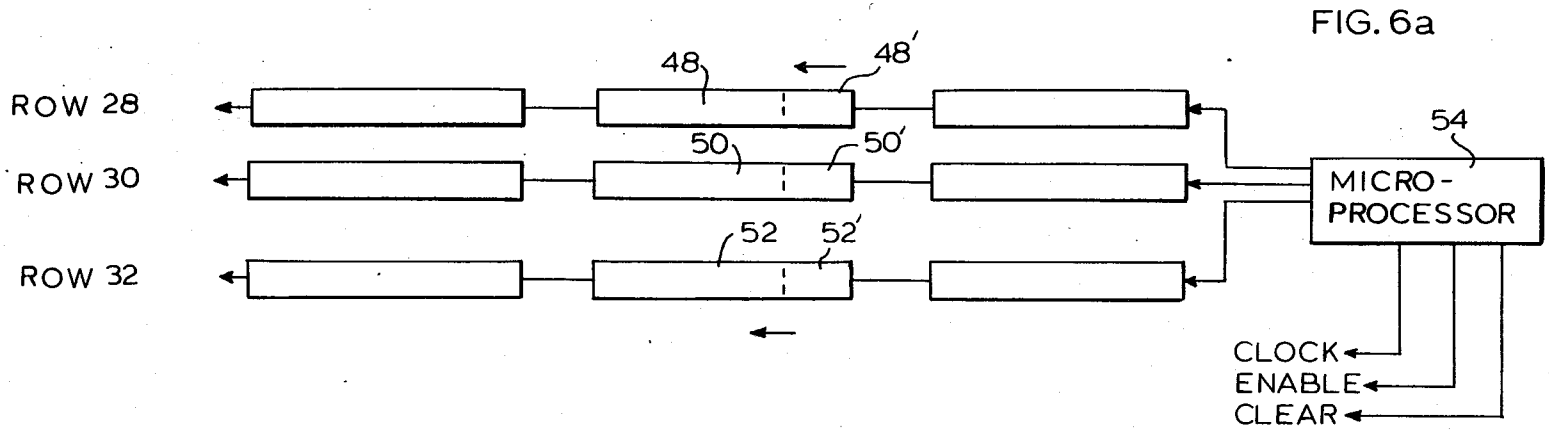
FIG. 6*a* shows the interconnection of special boards for shifting a message to the left across the display unit and for a static message.

In the present invention, if a right-to-left message shift is desired, the rows are connected as shown in FIG. 6*a*. In FIG. 6*a* the boards corresponding to rows 28, 30 and 32 are shown. For example the display elements of each row 28, 30, and 32 of FIG. 5*a* could be disposed on the right third 48', 50', 52' of boards 48, 50 and 52 (assuming of course that each board has 24 display elements). In order to generate messages each row gets its SERIES IN signal from a microprocessor 54. The microprocessor is adapted to send a series of "1" and "0" as required to generate the desired message. Microprocessor 54 also generates the signals on the CLOCK, ENABLE and CLEAR buses. Each one of these buses is connected to each of the boards of the display unit so that the signals on these buses are applied simultaneously to every control circuit 18.

Figure 7A:
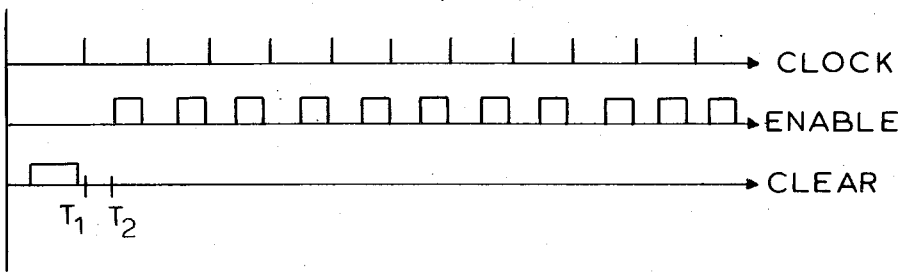
FIG. 7*a, b,* and *c* show the timing signals for a laterally shifted message, a vertically shifted message, and a static message respectively.

In order to generate a particular message, the microprocessor first sends a pulse (see FIG. 7*a*) on the CLEAR bus to reset all the latches. This signal results in a blank display unit. Next, the microprocessor sends an appropriate series of bits on each SERIES IN line dedicated to each row. These bits are shifted from right to left into the latches of board by appropriate CLOCK pulses. After each clock pulses an ENABLE signal is sent simultaneously to all the boards to activate the appropriate display elements simultaneously. Importantly, as shown in FIG. 7*a*, the CLOCK and ENABLE pulses never coincide. Instead the ENABLE pulses are generated only after a shift has been completed. During every ENABLE pulse the status of each latch remains unchanged so that the display unit present a steady, flickerless message.

Furthermore it should be appreciated the data bits, are shifted in each row simultaneously thus eliminating the above-described tilting effect.

In order to obtain the display shown on FIG. 5*a*, the latches controlling portions 48', 50' and 52' of the corresponding boards contain the following bits at time T1.

TABLE 1

| | |
|---|---|
| ROW 28 | 00000000 |
| ROW 30 | 00111110 |
| ROW 32 | 00100000 |

At the next positive transition of the CLOCK pulse all the bits are simultaneously shifted to the left so that at the next ENABLE at T2, following the CLOCK pulse, the latches contain the following bits:

TABLE 2

| | |
|---|---|
| ROW 28 | 00000000 |
| ROW 30 | 01111100 |
| ROW 32 | 01000000 |

Thus the data bits are shifted laterally across the board from right to left producing a corresponding shift of the message. While the Enable line is high, the display elements which correspond to the latches having a "1" bit are activated to display letter "E" as shown in FIG. 5*b*. Obviously the board connections may be reversed to obtained a shift from left to right.

Figure 6B:
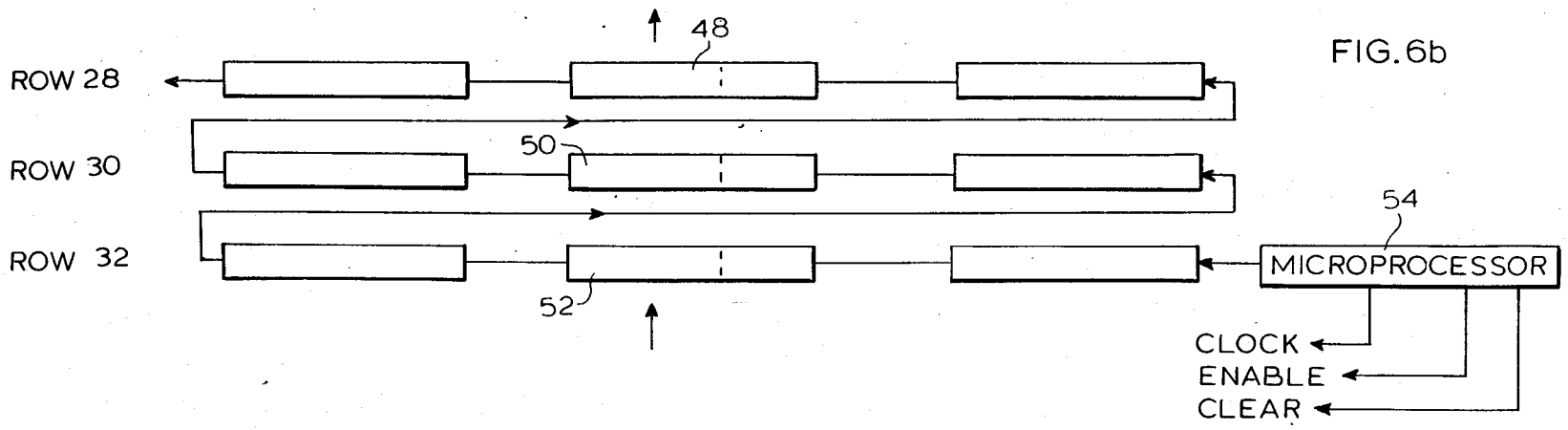
FIG. 6*b* shows the interconnector of the boards for shifting a message upward across the display unit.
Figure 7B:
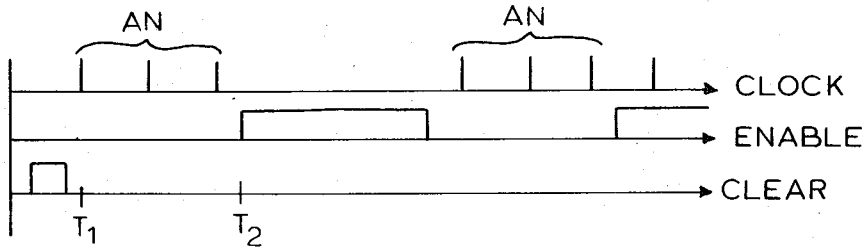
Figure 7C:
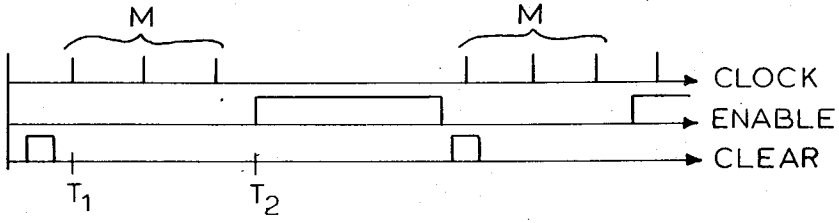

In some applications, it is more desirable to have the message vertically. In FIG. 6*b*, the rows 28, 30 and 32 have been connected so that the message is shifted vertically upward. In this configuration the microprocessor sends the data only to the M-th row. The SERIAL OUT line of each row is then connected to the SERIAL IN line of the row disposed immediately above it. Thus the information is passed sequentially across each row upward. In this configuration, as shown in FIG. 7*b*, after the initial CLEAR signal, the microprocessor generates AN clock pulses where A is the number of display elements per board and N is the number of boards per row. Thus in effect after each AN clock pulses the contents of each row are completely transferred to the next row upward. After each AN pulses there follows an ENABLE pulse which selectively activates the display elements as described above. Preferably the duration of each ENABLE pulse is equal to AN pulses to provide at least a 50% duty cycle for the display elements. After the ENABLE pulse there follows another AN clock pulses are generated to move the data one more row upwards. The CLOCK, ENABLE and CLEAR signals for the vertical shift are shown in FIG. 7*b*.

More particularly if the latches of the display elements of FIG. 5*a*, rows 28, 30 and 32 contain the bits shown in TABLE 1 above, at T1 than AN CLOCK pulses later, at T2 the same latches contain the following bits:

TABLE 3

| | |
|---|---|
| ROW 28 | 00111110 |
| ROW 30 | 00100000 |
| ROW 32 | 00100000 |

The result is shown in FIG. 5*c*. In order to save time, instead of feeding the data for each row sequentially, the microprocessor may be adapted to feed the p bottom rows 81 simultaneously, p being the number of rows needed per character. For the character of FIG. 5*a*, p=7. After each line of the message is fed to the n bottom rows, it is then shifted upwards one row at a time.

Clearly, the connection of the boards may be reversed to cause the message to shift vertically downwards.

In a third configuration, the display unit may be used to display static messages. In this configuration an entire message is displayed on the displayed unit for a preselected length of time after which the unit is cleared and a new message is displayed. For this configuration the board interconnection of FIG. 6*a* is used and the data c(orresponding to each message is shifted to each row completely before being displayed through the ENABLE signal. Between each ENABLE signal the same data is fed into the boards until a new message is required. Alternatively, the content of each latch is left undisturbed by sending CLOCK pulses to the boards only when a new message is being generated.

The actual number of rows and columns for the display unit depends on the particular application. For example, the display unit described above is well suited for continuously displaying stock market information. For this application 20×12 board is used to generate a 20×288 array of display elements. In this configuration the boards may be interconnected for lateral movement and can display standard stock market information comprising 48 characters at 900 characters per minute. The CLOCK rate for this application is 5.55 msec. The vertical shift configuration may be used for displaying news or similar items of interest to the public. In this configuration the display unit preferably comprises an array of 57×288 display elements.

The static configuration may be used to display either a single line of characters, or to emulate a CRT screen. In this latter application an array in the range of 20×96 to 240×480 display elements may be used and the message may be changed at up to 40 frames per second.

In all these applications, every display element is activated at the same time to eliminate he above described tilt or sway.

In the applications where the messages are shifted, the shift is done at a uniform acceleration and decelaration resulting in a smooth movement pleasant to the eye.

As previously mentioned, each display element 14 comprises an LED. The field effect transistor or switch 26 associated with each display element 14 is designed to have a source-to-drain resistance of 50 ohms and source-to-drain voltage drop of about 1 volt when its input voltage (i.e. Vcc from gate 24) is about 9 VDC. This provides 20 mA of current through the LED. However the voltage drop across the LED varies from one manufacturing lot or another producing large variations in the intensity of the LED when the LED power supply voltage is near the LED threshold voltage. This intensity variation is virtually eliminated in the present circuit because the controlled channel resistance of the FET and its source-to-drain voltage provides a feedback which compensates for variations of LED threshold voltage and approaches a controlled constant current driver for uniform brightness. The overall brightness of the display unit is controlled by varying the level of Vcc. Varying the Vcc between 5 and 12 VCD changes the current through the LED from 10 to 30 ma producing a brightness range of 3:1. On the hand a much coarser adjustment is obtained if the LED supply (i.e. the voltage on the LAMP line, FIG. 2) is varied.

Obviously numerous modifications may be made by one skilled in the art without departing from the scope of the invention as defined in the appended claims.

I claim:

1. A display unit comprising:

a plurality of display elements arranged in an array of rows and columns;

a plurality of memory elements adapted to store information indicative of the status of said display element, each memory element being associated with one of said display elements, memory elements corresponding to each row being arranged and connected to pass said information to an adjacent memory element along a preselected direction;

control means for feeding said information into said memory elements; and a plurality of FETs, each FET having a gate connected directly to a corresponding memory element, each of said FETs having a channel resistance and source to drain voltage controlled by a voltage on said gate indicative of the status of a respective display element, from said memory element to provide a feed-back to said gate thereby providing a constant current source to the corresponding display element for a uniform brightness.

2. The display unit of claim 1 wherein each memory element is adapted to activate a corresponding display element when receiving an enabling signal.

3. The display unit of claim 2 wherein each memory element is adapted to shift said information to an adjacent memory element of a corresponding row when receiving a clock signal.

4. The display unit of claim 3 wherein messages are shifted horizontally across said array by providing appropriate information to one of said memory elements of each row, shifting serially the information across each row and activating said display elements after each shift.

5. The display unit of claim 3 wherein messages are shifted vertically across said array by providing appropriate information to the memory elements of one of said rows, shifting said information to an adjacent row and activating the display elements after each row shift.

6. A display unit comprising:

a plurality of boards, each board having:

a plurality of display elements, said boards being arranged and constructed to form an array of display elements arranged in rows and columns, a plurality of memory elements for storing information indicative of the status of an associated display element, said memory elements being connected in series to pass information from one memory element to an adjacent memory element in a preselected direction;

a plurality of FETs, each FEt having a gate connected directly to a corresponding memory element, each of said FETs having a channel resistance and source to drain voltage controlled by a voltage on said gate indicative of the status of a respective display element from said memory element to provide a feedback to said gate thereby providing a constant current source to the corresponding display element for a uniform brightness;

said boards being arranged and connected so that each row comprises several boards connected in series; and control means for providing said information to said boards for generating a preselected message.

7. The display unit of claim 6 further wherein each board further comprises buffer means disposed between each memory element and the associated display element for driving said display element gating means for activating said buffer means when an enabling signal is received from said control means.

8. The display unit of claim 6 wherein said memory element is D-type latch.

9. The display unit of claim 7 wherein said buffer means comprises an FET.

10. The display unit of claim 7 wherein said display element is an LED.

11. The displaly unit of claim 6 wherein said control means is connected to one of the boards corresponding to each row and is adapted to provide a CLOCK signal for shifting information across each row concurrently to move a preselected message horizontally across the display.

12. The display unit of claim 6 wherein said control means is connected to one of the boards of one of said rows, said control means being adapted to generate a clock signal for shifting information across said rows, the boards of each row being connected to the boards of one of the adjacent rows to shift information in a preselected direction from one row to another in accordance with said clock signal, whereby a preselected message is shifted vertically across said display unit in a preselected direction.

* * * * *